US011130355B2

(12) United States Patent
Mizutani et al.

(10) Patent No.: US 11,130,355 B2
(45) Date of Patent: Sep. 28, 2021

(54) CONTACT MEMBER, PRINTING DEVICE, AND PRINTING METHOD

(71) Applicant: RICOH COMPANY, LTD., Tokyo (JP)

(72) Inventors: Yuuki Mizutani, Kanagawa (JP); Tomohiro Tamai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/962,098

(22) PCT Filed: Mar. 18, 2019

(86) PCT No.: PCT/JP2019/011172
§ 371 (c)(1),
(2) Date: Jul. 14, 2020

(87) PCT Pub. No.: WO2019/181850
PCT Pub. Date: Sep. 26, 2019

(65) Prior Publication Data

US 2020/0338905 A1 Oct. 29, 2020

(30) Foreign Application Priority Data

Mar. 19, 2018 (JP) ..... JP2018-051310

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01; B41J 11/0024; B41J 11/0022
See application file for complete search history.

(56) References Cited

U.S. PATENT DOCUMENTS

2008/0098916 A1 5/2008 Inoue
2011/0151370 A1* 6/2011 Shitara ..... G03G 9/08795 430/109.4
2011/0261133 A1 10/2011 Aoki et al.

FOREIGN PATENT DOCUMENTS

| | | | |
|---|---|---|---|
| CN | 101168332 | | 4/2008 |
| CN | 102236313 | | 11/2011 |
| CN | 102838899 | | 12/2012 |
| JP | 6-317999 | A | 11/1994 |
| JP | 8-123232 | A | 5/1996 |
| JP | 8-270639 | A | 10/1996 |
| JP | 2009-037012 | A | 2/2009 |
| JP | 2011-107729 | A | 6/2011 |
| JP | 2014-156317 | A | 8/2014 |

(Continued)

OTHER PUBLICATIONS

International Search Report and Written Opinion dated Jun. 24, 2019 in PCT/JP2019/011172 filed on Mar. 18, 2019.

(Continued)

*Primary Examiner* — Bradley W Thies
(74) *Attorney, Agent, or Firm* — Grüneberg and Myers PLLC

(57) ABSTRACT

A contact member (4) includes a surface containing a fluororesin fiber layer containing a fluororesin fiber, wherein the surface contacts a contact-target member (6) having an area to which a liquid composition is applied and the fluororesin fiber layer has a thickness of 500 pm or more.

20 Claims, 4 Drawing Sheets

(56) References Cited

FOREIGN PATENT DOCUMENTS

| | | |
|---|---|---|
| JP | 2017-072711 A | 4/2017 |
| JP | 2017-136838 A | 8/2017 |

OTHER PUBLICATIONS

Office Action dated Jul. 22, 2021 in Chinese Application No. 201980019664.3.

* cited by examiner

CONTACT MEMBER, PRINTING DEVICE, AND PRINTING METHOD

TECHNICAL FIELD

The present invention relates to a contact member, a printing device, and a printing method.

BACKGROUND ART

Printing devices such as inkjet devices include conveyor devices to convey printing media such as cut sheets. This conveyor device conveys printing media to a liquid composition applying device that applies a liquid composition such as inkjet ink, and to a liquid composition heating device that heats the applied liquid composition to dry. Such a conveyor device is provided in various forms. In many cases, a plurality of rollers are disposed spaced therebetween along the axial direction.

The liquid composition heating device evaporates the solvent of the liquid composition applied onto the recording medium such as a cut sheet with heat, infrared rays, etc., to dry the liquid composition. In terms of efficiency, a contact drying method of bringing the liquid composition applied onto a printing medium into direct contact with a heated contact member. This contact member is often provided as a roller, which serves as a conveyor device as well as a heating device. In such a contact drying method, the liquid composition on the printing medium directly contacts a heated roller. Therefore, if the liquid composition is not sufficiently dried or a resin contained in the liquid composition is softened, the liquid composition may be unfavorably transferred onto the roller.

Japanese Unexamined Patent Application Publication No. 2014-156317 discloses a roller including a rod-like core member and a wire rod containing slippery resin fiber disposed helically wound around the outer circumferential surface of the core member. The roller is used to convey a printing medium in a device capable of printing. Japanese Unexamined Patent Application Publication No. 2014-156317 mentioned above also discloses that the slippery resin fiber is made of fluororesin fiber and the wire rod has a height of from 10 to 200 μm from the outer surface of the core member.

CITATION LIST

Patent Literature

PTL 1: Japanese Unexamined Patent Application Publication No. 2014-156317

SUMMARY OF INVENTION

Technical Problem

However, when a high pressure is applied between such a printing medium and a contact member during high performance printing, the liquid composition on the contact-target member is unfavorably transferred onto the contact member.

Solution to Problem

According to the present disclosure, a contact member is provided which includes a surface including a fluororesin fiber layer containing a fluororesin fiber, wherein the surface contacts a contact-target member having an area to which a liquid composition is applied and the fluororesin fiber layer has a thickness of 500 μm or more.

Advantageous Effects of Invention

According to the present disclosure, the contact member is provided which is capable of diminishing transfer of a liquid composition on the contact-target member onto the contact member when a high pressure is applied between a printing medium and the contact member during high printing performance.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
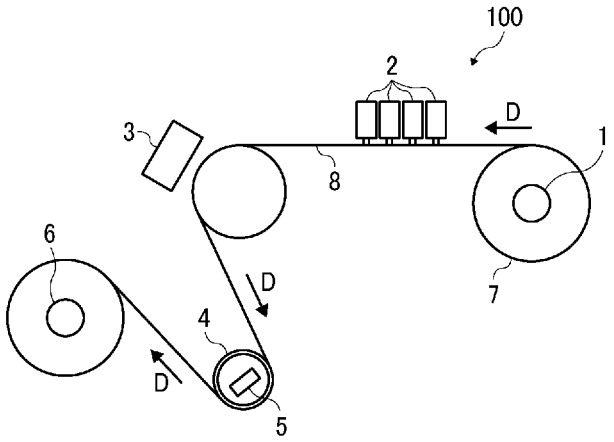
FIG. 1 is a schematic diagram illustrating a printing device using continuous paper.

The terminology used herein is for the purpose of describing particular embodiments only and is not intended to be limiting of the present invention. As used herein, the singular forms "a", "an" and "the" are intended to include the plural forms as well, unless the context clearly indicates otherwise. In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. Next, an embodiment of the present disclosure is described.

Contact Member

The contact member according to an embodiment of the present disclosure includes a surface including a fluororesin fiber layer containing a fluororesin fiber, wherein the surface contacts a contact-target member having an area to which a liquid composition is applied and the fluororesin fiber layer has a thickness of 500 μm or more.

The contact member preferably includes a substrate and the fluororesin fiber layer disposed on the substrate. In addition, the contact member may further optionally include one or more layers disposed between the substrate and the fluororesin fiber layer. In one example, the substrate and the fluororesin fiber layer are joined together by fusion, an adhesive such as primer, or a combination of the foregoing.

Fluororesin Fiber Layer

The contact member according to the present embodiment includes a surface brought into contact with the contact-target member. The surface includes a fluororesin fiber layer containing fluororesin fiber. The fluororesin fiber layer preferably includes fluororesin fiber at the uppermost surface of the layer. The use of fluororesin for forming the resin fiber improves lubricity and releasability of the surface brought into direct contact with the area of the contact-target member where the liquid composition is applied. Examples of the fluororesin forming the fluororesin fiber include, but are not limited to, a tetrafluoroethylene-perfluoroalkylvinyl ether copolymer (PFA, melting point: 300 to 310 degrees C.), polytetrafluoroethylene (PTFE, melting point: 330 degrees C.), a tetrafluoroethylene-hexafluoropropylene copolymer (FEP, melting point: 250 to 280 degrees C.), an ethylene-tetrafluoroethylene copolymer (ETFE, melting point: 260 to 270 degrees C.), polyvinylidene fluoride (PVDF, melting point: 160 to 180 degrees C.), polychlorotrifluoroethylene (PCTFE, melting point: 210 degrees C.), a tetrafluoroethylene-hexafluoropropylene-perfluoroalkylvinyl ether copolymer (EPE, melting point: 290 to 300 degrees C.), and copolymers including such polymers. Of these, polytetrafluoroethylene (PTFE) is preferable.

The fluororesin fiber is formed by spinning such fluororesin. The fluororesin fiber may be formed of a single fluororesin, a resin fiber formed of a plurality of fluororesins, or a resin fiber formed of at least one fluororesin and another material. Of these, the fluororesin fiber formed of a single fluororesin or a plurality of fluororesins. In this embodiment, the fluororesin fiber means fiber provided by turning fluororesin into fiber, or fiber provided by turning a mixture including fluororesin and another material into fiber. Therefore, for example, the fluororesin fiber according to this embodiment excludes a material obtained by coating and hardening the surface of glass resin fiber with fluororesin.

Specific examples of commercially available fluororesin fiber include, but are not limited to, TOYOFLON BF800S, 2402, and 1412 (manufactured by Toray Industries, Inc.), each of which contains polytetrafluoroethylene (PTFE).

The fluororesin fiber layer has a thickness of 500 μm or more and preferably 600 μm or more. The fluororesin fiber layer has a thickness of 1500 μm or less and preferably 1000 μm or less. The surface having a fluororesin-fiber structure having a layer thickness of 500 μm or more can disperse the contact pressure at the contact surface between the contact member and the contact-target member in a direction perpendicular to the contact surface even when the contact pressure is high. As a result, the liquid composition on the contact-target member is not easily transferred when the contact member comes into contact with the liquid composition applied region of the contact-target member. In addition, when the contact member having this fluororesin-fiber structure having a layer thickness of 1500 μm or less is a roller, the contact-target member is suitably conveyed. Also, when the layer having a fluororesin-fiber structure has a thickness of from 600 to 1500 μm or less, the liquid composition on the contact-target member is not easily transferred onto the contact member. When the fluororesin fiber layer has a thickness of 600 μm or more, the pressure can be further dispersed in a direction perpendicular to the contact surface between the contact member and the contact-target member. When the fluororesin fiber layer has a thickness of 1500 μm or less, the fiber structure is not easily disturbed by friction between the fluororesin fiber layer and the contact-target member.

The fiber forming the fluororesin fiber layer may have a multifilament structure or a monofilament structure, which is preferable. Since such a monofilament fiber is not easily permeated with the liquid composition, when the contact member comes into contact with the liquid composition applied region of the contact-target member, the liquid composition on the contact-target member is not easily transferred onto the contact member.

The fluororesin fiber layer is not particularly limited in terms of form, and has, in one example, a sheet-like form disposed so as to be wound around a substrate. The sheet-like form means that the fluororesin fiber layer obtained by a process of making fibers less likely to be separated from each other has a flat-surface form or a curved-surface form. This sheet-like form does not include a linear form. The fiber less likely to be separated from each other is produced by, for example, a known process, such as a process of mechanically weaving fibers provided by spinning a raw material by extrusion, or a process of bonding fibers together by, for example, heat or pressure. A process of bonding together relatively short fibers is preferably employed because while the contact area is decreased, the number of contact points is increased. When the fluororesin fiber layer has a sheet-like form, portions of the contact member that are brought into contact with the contact-target member are the apex portions of fluororesin fibers positioned outermost of the fluororesin fiber layer. Due to this structure, while the contact area between the contact member and the contact-target member is decreased, a large number of the apex portions of fluororesin fibers are provided at the surface of the contact member. As a result, when the contact member comes into contact with the liquid composition applied region of the contact-target member, the liquid composition on the contact-target member is not easily transferred onto the contact member. This embodiment does not exclude another form of the fluororesin fiber layer formed by winding linear fluororesin fiber around a substrate. However, as in the above-described example, the fluororesin fiber layer having a sheet-like form is preferable. This is because, when the fluororesin fiber layer has a sheet-like form, compared with a linear form, the pressure between the contact member and the contact-target member is dispersed, so that the liquid composition on the contact-target member is not easily transferred onto the contact member.

Substrate

The substrate is, in one example, a long rod-like metal member, and, in another example, has a roller-like form such as a solid or hollow cylinder having a circular cross section. When the substrate has such a form, the contact member can be used as a roller to convey the contact-target member. When a roller is used as the contact member, the circular cross section of the substrate has a diameter of from 50 to 100 μm in one example, and 60 to 90 μm in another example. In a case where the diameter is in this range, when the contact member comes into contact with the liquid composition applied region of the contact-target member, the liquid composition on the contact-target member is not easily transferred onto the contact member. When the diameter is 50 μm or more, the pressure per unit area between the contact member and the contact-target member is decreased, so that the liquid composition is not easily transferred. When the diameter is 100 μm or less, slipping between the contact member and the contact-target member is diminished, so that the liquid composition is not easily transferred.

Examples of the raw material for the substrate include various metals such as stainless steel and aluminum, sintered bodies of metals such as copper and stainless steel, and ceramic sintered bodies.

The substrate is a porous body in one example. If a fluororesin fiber layer is disposed on such a porous substrate to obtain the contact member, which is brought into contact with the liquid composition applied region of the contact-target member, the liquid composition on the contact-target member is not easily transferred onto the contact member. This is because, when the contact member comes into contact with the contact-target member to cause a pressure, the fluororesin fiber layer enters the pores in the surface of the porous body, thereby dispersing the pressure. The substrate is a porous body, so that, when the liquid component evaporates from the liquid composition on the contact-target member, the evaporating component can be released through the fluororesin fiber layer and the porous substrate. This reduces formation of droplets from the liquid component that has evaporated from the surface of the contact member. Examples of the raw material for the porous substrate include sintered bodies of metals such as copper and stainless steel, and ceramic sintered bodies. When the contact member including such a porous substrate is heated and used as a device to dry the liquid composition applied region on the contact-target member, the substrate is formed of, in one example, a sintered body of a metal such as copper, which has a high thermal conductivity, or stainless steel.

Printing Device

The printing device according to an embodiment of the present disclosure includes a contact member configured to come into contact with a region of a contact-target member to which a liquid composition is applied, the contact member including, at a surface for coming into contact with the contact-target member, a fluororesin fiber layer containing fluororesin fiber and having a thickness of 500 μm or more.

The printing device includes the above-described contact member, and may further optionally include, for example, a contact-target-member-feeding device configured to feed the contact-target member, a liquid-composition-applying device configured to apply a liquid composition to the fed contact-target member, a liquid-composition-heating device configured to heat the liquid composition applied to the contact-target member, and a contact-member-heating device configured to heat the contact member.

The printing device will be described with reference to FIG. 1. FIG. 1 is a schematic diagram illustrating a printing device using continuous paper according to an embodiment. A printing device 100 illustrated in FIG. 1 includes a contact-target-member-feeding device 1, a liquid-composition-applying device 2, a liquid-composition-heating device 3, a contact member 4, a contact-member-heating device 5, and a contact-target-member-collecting device 6.

Contact-Target-Member-Feeding Device

The contact-target-member-feeding device 1 is rotationally driven to feed the contact-target member 7 wound up into a roll, to a conveying path 8 in the printing device 100. The conveyance directions of the contact-target member 7 in the conveying path 8 are indicated by arrows D.

The rotational driving of contact-target-member-feeding device 1 is controlled so as to convey the contact-target member 7 at a high speed of 50 m/min or more.

The contact-target member 7 is a sheet-like conveying article continuously extending in the conveying direction D of the printing device 100, specifically, a recording medium such as continuous paper. Examples of the continuous paper include, but are not limited to, machine-glazed paper wound up into a roll, and regularly folded fanfold paper. The contact-target member 7 is conveyed along the conveying path 8, which extends between the contact-target-member-feeding device 1 and the contact-target-member-collecting device 6. The length of the contact-target member 7 in the conveying direction D is at least greater than the length of the conveying path 8 disposed between the contact-target-member-feeding device 1 and the contact-target-member-collecting device 6. The printing device 100 according to this embodiment is configured to use the contact-target member 7, which continuously extends in the conveying direction D of the printing device 100, and configured to convey the contact-target member 7 at a high speed. Therefore, a high tension is applied to the contact-target member 7 between the contact-target-member-feeding device 1 and the contact-target-member-collecting device 6.

Liquid Composition Applying Device

The liquid composition applying device 2 is an inkjet discharging head including a plurality of nozzle arrays, each including a plurality of nozzles. This inkjet discharging head is disposed such that discharging of ink from the nozzles is directed to the conveying path 8 of the contact-target member 7. Therefore, the liquid composition applying device 2 sequentially discharges, as a liquid composition to the contact-target member 7, inks of colors of magenta (M), cyan (C), yellow (Y), and black (K), and a post-processing solution applied to protect the surface of the provided inks. The colors of the inks discharged are not limited to these colors, and may be, for example, white, gray, silver, gold, green, blue, orange, or violet.

This embodiment has been described with an example in which the liquid composition is the inks and the post-processing solution. Alternatively, another liquid composition may be used. Examples of the liquid composition include, but are not limited to, ink, a pre-processing solution applied to aggregate coloring material contained in ink, a post-processing solution applied to protect the surface of applied ink, a liquid containing dispersed inorganic particles such as metal particles and used for forming, for example, electric circuits, and appropriate combinations of the foregoing such as mixtures and overlapped liquids.

This embodiment has been described with an example in which the liquid composition is provided with an inkjet discharging head to the contact-target member 7. Alternatively, the liquid composition may be applied by another device. Specific examples include, but are not limited to, various known methods such as spin coating, spray coating, gravure roll coating, reverse roll coating, and bar coating.

Liquid Composition Heating Device

The liquid composition heating device 3 is configured to blow hot air to dry the liquid composition applied to the contact-target member 7. The method of drying the liquid composition is not limited to the method of blowing hot air. Examples of other methods include, but are not limited to, various known methods such as a method of bringing the back surface of the contact-target member 7 into contact with, for example, a heating roller or a flat heater to dry the liquid composition.

Contact Member

The contact member 4 is configured to convey the contact-target member 7 and change the conveying direction D of the contact-target member 7. The contact member 4 is a solid or hollow cylindrical roller.

As described above, in the printing device 100 according to this embodiment, the contact-target-member-feeding device 1 is configured to convey the contact-target member 7 at 50 m/min or more. In such high-speed conveying, as illustrated in FIG. 1, when the conveying direction of the contact-target member 7 is changed using the contact member 4, a high pressure is applied between the contact member 4 and the contact-target member 7. As a result, when the liquid-composition-applied region on the contact-target member 7 comes into contact with the contact member 4, the liquid composition tends to be transferred onto the contact member 4. To prevent this transfer, the contact member according to this embodiment is suitably used.

The printing device 100 according to this embodiment is configured to use the contact-target member 7, which continuously extends in the conveying direction D of the printing device 100, and configured to convey the contact-target member 7 at a high speed. Therefore, a high tension is applied to the contact-target member 7 between the contact-target-member-feeding device 1 and the contact-target-member-collecting device 6. In such a case, as illustrated in FIG. 1, when the conveying direction of the contact-target member 7 under a high tension is changed by the contact member 4, a high pressure is applied between the contact member 4 and the contact-target member 7. As a result, when the liquid-composition-applied region on the contact-target member 7 comes into contact with the contact member 4, the liquid composition tends to be transferred onto the contact member 4. To prevent this transfer, the contact member according to this embodiment is suitably used.

As illustrated in FIG. 1, the contact member 4 is disposed downstream of the liquid composition heating device 3 in the conveying direction D of the contact-target member 7. After the liquid composition on the contact-target member 7 is dried by the liquid composition heating device 3, the liquid-composition-applied region on the contact-target member 7 comes into contact with the contact member 4. This di-minishes transfer of the liquid composition onto the contact member 4.

After the liquid composition on the contact-target member 7 is dried by the liquid composition heating device 3, the member that firstly comes into contact with the liquid-composition-applied region of the contact-target member 7 is the contact member 4 in one example. The liquid composition on the contact-target member 7 tends to be transferred onto the member that firstly comes into contact with the liquid-composition-applied region of the contact-target member 7. For this reason, to prevent this transfer, the contact member according to this embodiment is suitably used.

As illustrated in FIG. 1, when the contact member 4 is a roller, the contact-target member 7 is wound around the roller so that the roller comes into contact with the liquid-composition-applied region of the contact-target member 7. At this point in time, the winding ratio of the contact-target member 7 to the roller is preferably 10 percent or more, more preferably 15 percent or more, and furthermore preferably 20 percent or more. When the winding ratio is 10 percent or more, the pressure per unit area occurring between the roller and the contact-target member 7 is decreased, thereby diminishing transfer of the liquid composition onto the roller. The winding ratio of the contact-target member 7 to the roller is preferably 90 percent or less, more preferably 70 percent or less, and furthermore preferably 50 percent or less. When the winding ratio is 50 percent or less, the contact-target member 7 is suitably conveyed.

Figure 2:
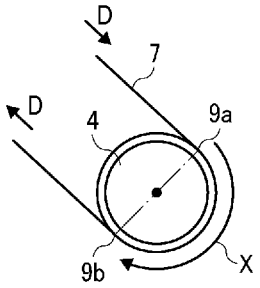
FIG. 2 is a schematic diagram illustrating a state in which a contact-target member is in contact with a contact member.

The "winding ratio" in this embodiment will be described with reference to FIG. 2. FIG. 2 is a schematic diagram illustrating the contact-target member in contact with the contact member. As illustrated in FIG. 2, when the contact-target member 7 is wound around and in contact with the contact member 4 having a roller-like form, the "winding ratio" represents the ratio of X to the whole circumference of the contact member 4, where X represents the circumference of the portion of the contact member 4 between an end 9*a* and the other end 9*b* where the contact-target member 7 is separated from the contact member 4 on the side on which the contact member 4 and the contact-target member 7 contact each other.

Contact-Member-Heating Device

The contact-member-heating device 5 is configured to heat the contact member 4. Therefore, the heated contact member 4 comes into contact with the liquid-composition-applied region of the contact-target member 7, thereby drying the liquid-composition-applied region on the contact-target member 7. At this point in time, because of, in addition to insufficient drying of the liquid composition, for example, thermally softening of resin contained in the liquid composition, the liquid composition tends to be unfavorably transferred onto the contact member 4. To prevent this transfer, the contact member according to this embodiment is suitably used.

The contact-member-heating device 5 may be selected from, for example, various known devices such as heaters and devices of blowing hot air.

As illustrated in FIG. 1, the contact-member-heating device 5 may be disposed inside of the contact member 4, or may be disposed outside of the contact member 4. The contact-member-heating device 5 may be separately from the contact member 4, or may be integrated into the contact member 4. When the substrate of the contact member 4 is a porous body and the contact-member-heating device 5 is disposed inside of the contact member 4, heat or hot air generated from the contact-member-heating device 5 can be efficiently delivered to the contact-target member 7.

Contact-Target-Member-Collecting Device

The contact-target-member-collecting device 6 is rotationally driven to wind up the contact-target member 7 having images formed with the liquid composition to store the contact-target member 7 in a roll form.

Printing Method

The printing method according to an embodiment of the present disclosure includes applying a liquid composition to a contact-target member and bringing a contact member into contact with the region of the contact-target member, where the liquid composition is applied. The printing method optionally includes heating the liquid composition.

Liquid Composition Application

In the liquid composition application, a liquid composition such as ink is applied to the contact-target member 7 fed from the contact-target-member-feeding device 1. This forms a liquid-composition-applied region on the contact-target member 7.

Liquid Composition Heating

The liquid composition is heated in the liquid composition heating to dry the liquid composition after the liquid composition is applied. In one example, the liquid composition is dried until the recording medium does not feel tacky. In the drying illustrated in FIG. 1, the applied liquid composition is dried with the liquid composition heating device 3. Alternatively, the applied liquid composition may be naturally dried without such a special drying device.

Contact

In the contact, the contact member 4 is brought into contact with the liquid-composition-applied region of the contact-target member 7. The liquid-composition-applied region means the liquid-composition-applied surface of the contact-target member 7, but does not include a region on the other side where the liquid composition is not applied.

As illustrated in FIG. 1, the contact-target member 7 is conveyed while the contact-target member 7 is in contact with the contact member 4. The contact member 4 conveys the contact-target member 7 such that the contact-target member 7 is wound around the contact member 4, thereby changing the conveying direction D of the contact-target member 7. When the contact-member-heating device 5 is disposed inside or near the contact member 4, the contact member 4 conveys the contact-target member 7 while the liquid-composition-applied region on the contact-target member 7 is dried.

Liquid Composition

The liquid composition in the present embodiment is not particularly limited. Examples include, but are not limited to. ink, a pre-processing solution applied to aggregate coloring material contained in ink, a post-processing solution applied to protect the surface of provided ink, and a liquid dispersion containing inorganic particles such as metal particles for forming, for example, electric circuits. These liquid compositions may be appropriately used in accordance with known formulations. Hereafter, an example of using, as the liquid composition, ink and a post-processing solution will be described.

Ink

Hereinafter, raw materials for ink, such as organic solvent, water, coloring material, resin, wax, and additives, will be described.

Organic Solvent

There is no specific limitation to the organic solvent for use in the present disclosure. For example, water-soluble organic solvents can be used. Examples include, but are not limited to, polyols, ethers such as polyol alkylethers and polyol arylethers, nitrogen-containing heterocyclic compounds, amides, amines, and sulfur-containing compounds.

Specific examples of the polyol include, but are not limited to, ethylene glycol, diethylene glycol, 1,2-propanediol, 1,3-propane diol, 1,2-butanediol, 1,3-butanediol, 1,4-butanediol, 2,3-butanediol, 3-methyl1,3-butanediol, trethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Specific examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzyl ether.

Specific examples of nitrogen-containing heterocyclic compounds include, but are not limited to, 2-pyrolidone, N-methyl-2-pyrolidone, N-hydroxyethyl-2-pyrolidone, 1,3-dimethyl-2-imidazoline, ε-caprolactam, and γ-butylolactone.

Specific examples of the amide include, but are not limited to, formamide, N-methyl formamide, N,N-dimethylformamide, 3-methoxy-N,N-dimethyl propionamide, and 3-buthoxy-N,N-dimethylpropionamide.

Specific examples of the amine include, but are not limited to, monoethanol amine, diethanol amine, and triethyl amine.

Specific examples of the sulfur-containing compounds include, but are not limited to, dimethyl sulphoxide, sulfolane, and thiodiethanol.

Also, for example, propylene carbonate, ethylene carbonate, etc. can be used as the organic solvent.

To serve as a humectant and impart a good drying property, it is preferable to use an organic solvent having a boiling point of 250 degrees C. or lower.

Polyol compounds having eight or more carbon atoms and glycol ether compounds are also suitable as the organic solvent. Specific examples of the polyol compounds having eight or more carbon atoms include, but are not limited to, 2-ethyl-1,3-hexanediol and 2,2,4-trimethyl-1,3-pentanediol.

Specific examples of the glycolether compounds include, but are not limited to, polyol alkylethers such as ethyleneglycol monoethylether, ethyleneglycol monobutylether, diethyleneglycol monomethylether, diethyleneglycol monoethylether, diethyleneglycol monobutylether, tetraethyleneglycol monomethylether, and propy-leneglycol monoethylether; and polyol arylethers such as ethyleneglycol monophenylether and ethyleneglycol monobenzylether.

In particular, if a resin is used as the ink composition, N,N-dimethyl-β-buthoxypropionamide, N,N-dimethyl-β-ethoxypropionamide, 3-ethyl-3-hydroxymethyloxetane, and propylene glycol monomethylether are preferable. These can be used alone or in combination. Of these, amide solvents such as 3-buthoxy-N,N-dimethyl propionamide and 3-methoxy-N,N-dimethyl propionamide are particularly preferable to promote film-forming property of a resin and demonstrate better abrasion resistance.

The boiling point of the organic solvent is preferably from 180 to 250 degrees C. When the boiling point is 180 degrees C. or higher, the evaporation speed during drying can be suitably controlled, leveling is sufficiently conducted, surface roughness is reduced, and gloss is improved. Conversely, when the boiling point is higher than 250 degrees C., drying property is not good so that drying takes a longer time. According to the advancement of print technologies, the time to be taken for drying becomes a rate limiting factor. Therefore, it is required to shorten the drying time and naturally drying taking a long time is not preferable.

The proportion of the organic solvent in the ink has no particular limit and can be suitably selected to suit to a particular application.

In terms of drying property and discharging reliability of ink, the proportion is preferably from 10 to 60 percent by mass and more preferably from 20 to 60 percent by mass.

The proportion of the amide solvent in the ink is preferably from 0.05 to 10 percent by mass and more preferably from 0.1 to 5 percent by mass.

Water

The proportion of water in the ink is not particularly limited and can be suitably selected to suit to a particular application. For example, in terms of the drying property and discharging reliability of the ink, the proportion is preferably from 10 to 90 percent by mass and more preferably from 20 to 60 percent by mass.

Coloring Material

The coloring material has no particular limit. For example, pigments and dyes are suitable.

As the pigment, inorganic pigments or organic pigments can be used. These can be used alone or in combination. In addition, it is possible to use a mixed crystal as the pigment.

As the pigments, for example, black pigments, yellow pigments, magenta pigments, cyan pigments, white pigments, green pigments, orange pigments, and gloss pigments and metallic pigments of gold, silver, etc., can be used.

As the inorganic pigments, in addition to titanium oxide, iron oxide, calcium carbonate, barium sulfate, aluminum hydroxide, barium yellow, cadmium red, and chrome yellow, carbon black manufactured by known methods such as contact methods, furnace methods, and thermal methods can be used.

As the organic pigments, it is possible to use azo pigments, polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinophthalone pigments, etc.), dye chelates (basic dye type chelates, acid dye type chelates, etc.), nitro pigments, nitroso pigments, and aniline black can be used. Of those pigments, pigments having good affinity with solvents are preferable. Also, hollow resin particles and hollow inorganic particles can be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1). Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red (PR) 1, 2, 3, 5, 17, 22, 23, 31, 38, 48:2, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 150, 166, 168, 170, 172, 177, 178, 179, 184, 185, 190, 193, 202, 207, 208, 209, 213, 219, 224, 254, 264, and 269; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63; C.I. Pigment Green 1, 4, 7, 8, 10, 17, 18, and 36. The dye is not particularly limited and includes, for example, acidic dyes, direct dyes, reactive dyes, basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C.I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the coloring material in the ink is preferably from 0.1 to 15 percent by mass and more preferably from 1 to 10 percent by mass in terms of enhancement of image density, fixability, and discharging stability.

To obtain an ink by dispersing a pigment, for example, a hydrophilic functional group is introduced into a pigment to prepare a self-dispersible pigment, the surface of a pigment is coated with a resin followed by dispersion, or a dispersant is used to disperse a pigment.

To prepare a self-dispersible pigment by introducing a hydrophilic functional group into a pigment, for example, it is possible to add a functional group such as a sulfone group and a carboxyl group to the pigment (e.g., carbon) to disperse the pigment in water.

To coat the surface of a pigment with a resin, the pigment is encapsulated by micro-capsules to make the pigment dispersible in water. This can be referred to as a resin-coated pigment. In this case, all the pigments to be added to ink are not necessarily entirely coated with a resin. Pigments partially or wholly uncovered with a resin are allowed to be dispersed in the ink unless such pigments have an adverse impact.

In a method of using a dispersant to disperse a pigment, for example, a known dispersant having a small molecular weight or a large molecular weight, which is represented by a surfactant, is used to disperse the pigment in ink.

As the dispersant, it is possible to use, for example, an anionic surfactant, a cationic surfactant, a nonionic surfactant, an amphoteric surfactant, etc. depending on a pigment.

Also, a nonionic surfactant (RT-100, manufactured by TAKEMOTO OIL & FAT CO., LTD.) and a formalin condensate of naphthalene sodium sulfonate are suitable as the dispersant.

Those can be used alone or in combination.

Pigment Dispersion

The ink can be obtained by mixing a pigment with materials such as water and an organic solvent. It is also possible to mix the pigment with water, a dispersant, etc., to prepare a pigment dispersion and thereafter mix the pigment dispersion with material such as water and an organic solvent to manufacture the ink.

The pigment dispersion is obtained by mixing and dispersing water, a pigment, a pigment dispersant, and other optional components and controlling the particle size. It is good to use a dispersing device for dispersion.

The particle diameter of the pigment in the pigment dispersion has no particular limit. For example, the maximum frequency is preferably from 20 to 500 nm and more preferably from 20 to 150 nm in the maximum number conversion to improve dispersion stability of the pigment and ameliorate discharging stability and the image quality such as image density. The particle diameter of the pigment can be measured using a particle size analyzer (Nanotrac Wave-UT151, manufactured by MicrotracBEL Corp).

In addition, the proportion of the pigment in the pigment dispersion is not particularly limited and can be suitably selected to suit a particular application. In terms of improving discharging stability and increasing image density, the proportion is preferably from 0.1 to 50 percent by mass and more preferably from 0.1 to 30 percent by mass.

It is preferable that the pigment dispersion be filtered with a filter, a centrifuge, etc., to remove coarse particles followed by degassing.

Resin

The type of the resin contained in the ink has no particular limit and can be suitably selected to suit to a particular application. Examples are urethane resins, polyester resins, acrylic-based resins, vinyl acetate-based resins, styrene-based resins, butadiene-based resins, styrene-butadiene-based resins, vinylchloride-based resins, acrylic styrene-based resins, and acrylic silicone-based resins.

Resin particles made of such resins can be also used. It is possible to mix a resin emulsion in which such resin particles are dispersed in water as a dispersion medium with materials such as a coloring material and an organic solvent to obtain an ink. It is possible to use suitably-synthesized resin particles. Alternatively, the resin particle is available on the market. These resin particles can be used alone or in combination.

Of the above-described examples, urethane resin particles are used together with other resin particles in one example because urethane-resin-particle ink provides images having high tackiness, which degrades blocking resistance. However, such high tackiness of urethane resin particles enables formation of strong images and enhancement of fixing properties. In particular, for urethane resin particles that have a glass transition temperature (Tg) of −20 to 70 degrees C., images formed with ink containing these urethane resin particles have higher tackiness and better fixing properties.

Of the above-described resins, acrylic resin particles formed of acrylic resin have high discharging stability and are also inexpensive, so that they are widely used. However, since acrylic resin particles have low abrasion resistance, and hence are used together with elastic urethane resin particles in one example.

The mass ratio (urethane resin particles/acrylic resin particles) of the urethane-resin-particle content (percent by mass) to acrylic-resin-particle content (percent by mass) is preferably from 0.03 to 0.70, more preferably from 0.10 to 0.70, and furthermore preferably from 0.23 to 0.46.

The volume average particle diameter of the resin particle is not particularly limited and can be suitably selected to suit to a particular application. The volume average particle diameter is preferably from 10 to 1,000 nm, more preferably from 10 to 200 nm, and furthermore preferably from 10 to 100 nm to obtain good fixability and image robustness.

The volume average particle diameter can be measured by using, for example, a particle size analyzer (Nanotrac Wave-UT151, manufactured by MicrotracBEL Corp.).

The proportion of the resin in the ink is not particularly limited and can be suitably selected to suit to a particular application. In terms of fixability and storage stability of ink, it is preferably from 1 to 30 percent by mass and more preferably from 5 to 20 percent by mass to the total amount of the ink.

The particle diameter of the solid portion in the ink has no particular limit and can be selected to suit to a particular application. The maximum frequency of the particle diameter of the solid portion in the ink is preferably from 20 to 1000 nm and more preferably from 20 to 150 nm in the maximum number conversion to enhance discharging stability and image quality such as image density. The solid portion includes resin particles, particles of pigments, etc. The particle diameter can be measured by using a particle size analyzer (Nanotrac Wave-UT151, manufactured by MicrotracBEL Corp).

Wax

Inclusion of wax in ink enhances abrasion resistance and the gloss degree can be enhanced when used in combination with a resin. The wax is polyethylene wax in one example. The polyethylene wax may be a commercially available product. Specific examples include, but are not limited to, AQUACER 531 (manufactured by BYK Japan KK), Polyron P502 (manufactured by Chukyo Yushi Co., Ltd.), Aquapetro DP2502C (manufactured by TOYO ADL CORPORATION), and Aquapetro DP2401 (manufactured by TOYO ADL CORPORATION). These can be used alone or in combination.

The proportion of the polyethylene wax is preferably from 0.05 to 2 percent by mass, more preferably from 0.05 to 0.5 percent by mass, and furthermore preferably from 0.05 to 0.45 percent by mass, and particularly preferably from 0.15 to 0.45 percent by mass to the total content of ink. When the polyethylene-wax content is from 0.05 to 2 percent by mass, abrasion resistance and glossiness are sufficiently enhanced. When the content is 0.45 percent by mass or less, ink becomes to have particularly high storage stability and discharging stability and the ink is more suitably used for inkjet processes.

Additive

The ink may further optionally include a surfactant, a defoaming agent, a preservative and fungicide, a corrosion inhibitor, a pH regulator, etc.

Post-Processing Fluid

The post-processing fluid has no particular limit. It is preferable that the post-processing fluid can form a transparent layer. The same material such as organic solvents, water, wax, resins, surfactants, defoaming agents, pH regulators, preservatives and fungicides, corrosion inhibitors, etc. as for the ink is suitably selected based on a necessity basis and mixed to obtain the post-processing fluid. The post-processing solution may be applied to the whole region of the contact-target member, or may be applied to only the ink-applied region.

Properties of Liquid-Composition-Applied Region

The liquid-composition-applied region preferably has a tackiness of from 80 to 110 nN. When the tackiness is 80 nN or more, binding strength of the region formed by application of the liquid composition (for example, an image region formed with ink as the liquid composition) is enhanced, thereby enhancing film strength and fixing properties. When the liquid-composition-applied region on the contact-target member has a tackiness of 110 nN or less and comes into contact with the contact member, the liquid composition is less likely to be transferred onto the contact member.

Figure 3:
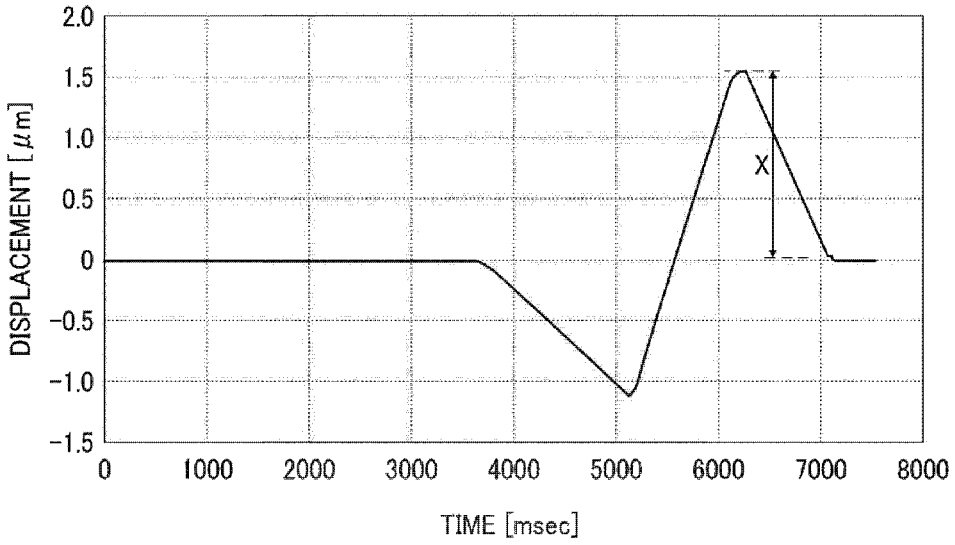
FIG. 3 is a graph illustrating a focus curve obtained by using an atomic force microscope.
Figure 4:
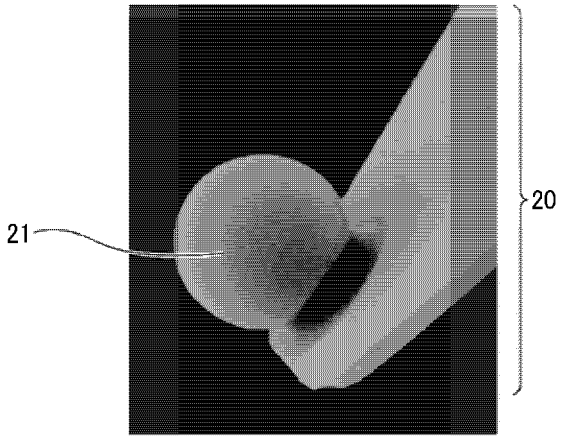
FIG. 4 is a micrograph of an example of cantilever equipped with a probe.

The tackiness of the liquid-composition-applied region can be calculated by, for example, the following method. The tackiness of the liquid-composition-applied region of the contact-target member is measured with an atomic force microscope (hereafter, may also be referred to as AFM, model name: SPM-9500J3, manufactured by SHIMADZU CORPORATION). The targets for measuring tackiness may be regions formed by application of the liquid composition onto the contact-target member with various printing devices. The probe of the AFM is brought into contact with the image, pressed into a depth of 100 nm, and pulled up. The warp of the cantilever is monitored when the probe is detached from the image to obtain a force curve as illustrated in FIG. 3. The tackiness power F (=kx) is obtained by multiplying a displacement amount x by the spring constant k of a cantilever 20 illustrated in FIG. 4. The cantilever 20 may be equipped with a silicon oxide sphere serving as a probe 21. The measuring conditions are: measuring temperature of 23 degrees C.; humidity of 35 percent RH; probe diameter of 3.5 μm; measuring mode of force curve measuring; and measuring frequency of 1 Hz.

The method of easily setting the tackiness of the liquid-composition-applied region to be from 80 to 110 nN is not particularly limited. For example, a method of using a liquid composition containing coloring material, water, organic solvent, and wax, or a method of setting a mass ratio (urethane resin particles/acrylic resin particles) of the urethane-resin-particle content (percent by mass) to the acrylic-resin-particle content (percent by mass) to 0.1 or more and 0.7 or less are suitable.

Contact-Target Member

The contact-target member is not particularly limited, and may be selected from recording media such as normal paper, glossy paper, specialty paper, and cloth. In one example, the contact-target member is particularly suitable for low-permeable recording media (also referred to as low-absorption recording media).

The low-permeable recording medium has a surface with low moisture permeability, absorbency, and/or adsorption property and includes a material having myriad of hollow spaces inside but not open to the exterior. Examples of the low-permeable recording medium include, but are not limited to, coated paper for use in commercial printing and a recording medium like coated paper board having a middle layer and a back layer mixed with waste paper pulp. In the case of such a low-permeable recording medium, when the liquid-composition-applied region on the contact-target member comes into contact with the contact member, the liquid composition tends to be transferred onto the contact member. To prevent this transfer, the contact member according to this embodiment is suitably used.

Low-Permeable Recording Medium

The low-permeable recording medium includes, for example, a substrate and a surface layer provided to at least one surface of the substrate. Also, the low-permeable recording medium includes a recording medium such as coated paper having other optional layers.

The recording medium including the substrate and the surface layer preferably has a transfer amount of pure water to the recording medium of from 2 to 35 mL/m$^2$ and more preferably from 2 to 10 mL/m$^2$ during a contact time of 100 ms as measured by a liquid dynamic absorptometer.

When the transfer amount of the ink and pure water during a contact time of 100 ms is too small, beading tends to occur. When the transfer amount is too large, the ink dot diameter tends to be smaller than desired after image forming.

The transfer amount of pure water to the recording medium is from 3 to 40 mL/m$^2$ and preferably from 3 to 10 mL/m$^2$ during a contact time of 400 m as measured by a liquid dynamic absorption tester.

When the transfer amount during the contact time of 400 ms is small, drying property becomes insufficient. When the transfer amount is too much, gloss of the image portion tends to be low after drying. The transfer amount of pure water to the recording medium during a contact time of 100 ms and 400 ms can be measured at the surface on which the surface layer is provided in both transfer amounts.

This dynamic scanning absorptometer (KUGA, Shigenori, Dynamic scanning absorptometer (DSA); Journal of JAPAN TAPPI, published in May 1994, Vol. 48, pp. 88-92) can accurately measure the liquid amount absorbed in an extremely small period of time. This dynamic scanning absorptometer automates the measuring utilizing the method of directly reading the absorption speed of liquid from moving of meniscus in a capillary, spirally scanning an imbibition head on a sample having a disc-like form, and measuring the required number of points on the single sample while automatically changing the scanning speed according to predetermined patterns.

The liquid supply head to a paper sample is connected with the capillary via a TEFLON™ tube and the position of the meniscus in the capillary is automatically read by an optical sensor. Specifically, the transfer amount of pure water or ink can be measured using a dynamic scanning absorptometer (K350 Series D type, manufactured by Kyowa Seiko Inc.).

Each of the transfer amount during the contact time of 100 ms and 400 ms can be obtained by interpolation from the measuring results of the transfer amount in the proximity contact time of the contact time.

Substrate

There is no specific limitation to the selection of the substrate and it can be suitably selected to suit to a particular application. For example, paper mainly formed of wood fiber and a sheet material such as non-woven cloth mainly formed of wood fiber and synthesized fiber are usable.

There is no specific limit to the thickness of the substrate. The layer thickness thereof can be determined and preferably ranges from 50 to 300 μm. The weight of the substrate is preferably from 45 to 290 g/m$^2$.

Surface Layer

The surface layer contains a pigment, a binder, and other components such as a surfactant.

As the pigments, inorganic pigments or a combination of inorganic pigments and organic pigments can be used. Specific examples of the inorganic pigments include, but are not limited to, kaolin, talc, heavy calcium carbonate, light calcium carbonate, calcium sulfite, amorphous silica, titanium white, magnesium carbonate, titanium dioxide, aluminum hydroxide, calcium hydroxide, magnesium hydroxide, zinc hydroxide, and chlorite. The addition amount of the inorganic pigment is preferably 50 parts by mass or more based on 100 parts by mass of the binder.

Specific examples of the organic pigments include, but are not limited to, water-soluble dispersions of styrene-acrylic copolymer particles, styrene-butadien copolymer particles, polystyrene particles, and polyethylene particles. The addition amount of the organic pigment is preferably from 2 to 20 parts by mass based on 100 parts by mass of all the pigments in the surface layer.

As the binder resin, aqueous resins are preferable. As the aqueous resins, at least one of water-soluble resins and water-dispersible resins are preferable. The water-soluble resin is not particularly limited and can be suitably selected to suit to a particular application. Examples thereof include polyvinyl alcohol, cation-modified polyvinyl alcohol, acetal-modified polyvinyl alcohol, polyester, and polyurethane.

The surfactant optionally contained in the surface layer is not particularly limited and can be suitably selected to suit to a particular application. Anionic active agents, cationic active agents, amphoteric active agents, and non-ionic active agent can be used.

The method of forming the surface layer is not particularly limited and can be suitably selected to suit to a particular application. For example, methods are utilized in which liquid forming the surface layer on a substrate is applied to the substrate or a substrate is immersed in the liquid constituting the surface layer. The attachment amount of the liquid forming the surface layer is not particularly limited and can be suitably selected to suit to a particular application. The attachment amount of the solid portion preferably ranges from 0.5 to 20 g/m$^2$ and more preferably from 1 to 15 g/m$^2$.

EXAMPLES

Next, the present disclosure is described in detail with reference to Examples but is not limited thereto.

Preparation Example of Black Pigment Dispersion 20 g of carbon black (NIPEX 160, manufactured by Degussa, BET specific surface area: 150 m$^2$/g, average primary particle size: 20 nm, pH: 4.0, DBP absorption number: 620 g/100 g), 20 mmol of a compound represented by Chemical structural 1 below, and 200 mL of deionized highly pure water were mixed in a room-temperature environment with a Silverson mixer at 6,000 rpm.

When the obtained slurry had a pH higher than 4, 20 mmol of nitric acid was added. 30 minutes later, 20 mmol of sodium nitrite dissolved in a minute amount of deionized highly pure water was slowly added to the mixture. Furthermore, the temperature was raised to 60 degrees C. while being stirred to allow reaction for one hour. As a result, a reformed pigment was produced in which the compound represented by Chemical structure 1 illustrated below was added to the carbon black.

Thereafter, by adjusting the pH to be 10 by NaOH aqueous solution, a dispersion of reformed pigment was obtained 30 minutes later. A dispersion containing a pigment bonded with at least one geminal-bisphosphonic acid group or a sodium salt of geminal bisphosphonic acid and deionized highly pure water were subject to ultrafiltration using a dialysis membrane followed by ultrasonic wave dispersion to obtain self-dispersible black pigment dispersion having a bisphosphonic acid group as a hydrophilic group with a pigment solid concentration of 16 percent.

[Chem.1]

Chemical structure 1

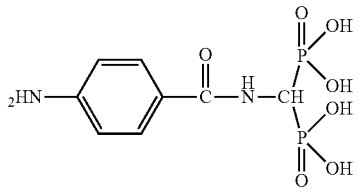

Preparation Example of Liquid Composition 1 (Ink)

The black-pigment dispersion (50.00 percent by mass, pigment solid-content concentration: 16 percent), 2.22 percent by mass of polyethylene wax (AQUACER 531, nonvolatile content: 45 percent by mass, manufactured by BYK Japan KK), 30.00 percent by mass of 3-ethyl-3-hydroxymethyloxetane, 10.0 percent by mass of propylene glycol monopropyl ether, and 2.00 percent by mass of silicone-based surfactant (TEGO Wet 270, manufactured by TOMOE ENGINEERING CO., LTD.) were mixed with deionized water as a balance. The mixture was stirred for one hour, and subsequently filtered through a membrane filter having an average pore size of 1.2 μm, to obtain Liquid composition 1 (ink).

Preparation Example of Liquid Composition 2 (Post-Processing Solution)

22 parts of 1,3-butane diol, 11 parts of glycerin, 15 parts of polyurethane emulsion (SU-U0705, manufactured by Japan Coating Resin Corporation) having a solid portion accounting for 35 percent by mass, 2 parts of 2-ethyl-1,3-hexane diol, 0.05 parts of fluorine-containing nonionic surfactant (Capstone™ FS-3100, manufactured by E. I. du Pont de Nemours and Company), 0.1 parts of 2,4,7,9-tetramethyl-4,7-decane diol, 0.2 parts of preservatives and fungicides (PROXELTMLV, available from Avecia Inkjet Limited), 10 parts of polyethylene wax (PORIRON P502, manufactured by CHUKYO YUSHI CO., LTD.) having a solid portion accounting for 30 percent by mass, and 39.65 parts of water were mixed to obtain Liquid composition 2 (post-processing solution).

Example 1

Production of Contact Member

To the surface of an aluminum hollow roller having a diameter of 75 mm (manufactured by MISUMI Group Inc.) serving as the substrate, TOYOFLON BF800S (monofilament, manufactured by Toray Industries, Inc.), which was fluororesin fiber having an adjusted thickness of 800 μm, was bonded with a silicone-based adhesive, to provide a contact member 1 having a fluororesin fiber layer Printing on Contact-Target Member An inkjet printing system (RICOH Pro VC60000, manufactured by Ricoh Co., Ltd.) was used to print images on a recording medium serving as a contact-target member. The contact-target member was machine-glazed paper Lumi Art Gloss 130 gsm (manufactured by Stora Enso, paper width: 520.7 mm). While this machine-glazed paper was conveyed at 50 m/min, a solid image was printed at a resolution of 1,200 dpi with Liquid composition 1 (ink), and thereafter Liquid composition 2 (post-processing solution) was immediately applied to this Liquid composition 1 to print a solid image.

Drying of Solid-Image Region

At two seconds later after the completion of the printing, the solid-image region (liquid-composition-applied region of the contact-target member) was exposed to hot air blown by a dryer (wind speed: 20 m/s, temperature of hot air: 100 degrees C.) for two seconds.

Contact Between Contact Member and Solid-Image Region of Contact-Target Member

At five seconds after the completion of the exposure to hot air, the contact member 1 and the solid-image region (liquid-composition-applied region of the contact-target member) were combined together with a winding ratio of 50 percent so as to be in contact with each other for 2 seconds, and the contact member 1 was separated perpendicularly from the solid-image region. While the contact member 1 and the solid-image region were brought into contact with each other, a pressure of 100 g/cm$^2$ was applied.

Measurement of Tackiness of Solid-Image Region

At one minute after the completion of the exposure to hot air, the tackiness of the solid-image region was measured.

The tackiness was measured with an atomic force microscope (model name: SPM-9500J3, manufactured by SHIMADZU CORPORATION). The cantilever was equipped with a silicon oxide sphere as the probe. The measuring conditions were: measuring temperature of 23 degrees C.; humidity of 35 percent RH; probe diameter of 3.5 μm; measuring mode of force curve measuring; and measuring frequency of 1 Hz.

Printing with Printing Device Including Contact Member

An inkjet printing system (RICOH Pro VC60000, manufactured by Ricoh Co., Ltd.) was remodeled by incorporating the contact member 1. Using the remodeled system, an image was printed on a recording medium as the contact-target member. The contact member 1 was incorporated, in the conveying path of the printing device, at a position downstream of a drying device for drying the applied liquid composition 1 (ink) and the liquid composition 2 (post-processing solution) such that the contact member 1 firstly came into contact with the region to which Liquid composition 1 (ink) and Liquid composition 2 (post-processing solution) were applied. The contact-target member was machine-glazed paper Lumi Art Gloss 130 gsm (manufactured by Stora Enso, paper width: 520.7 mm). While this machine-glazed paper was conveyed at 50 m/min, a solid image was printed at a resolution of 1,200 dpi with Liquid composition 1 (ink), and thereafter Liquid composition 2 (post-processing solution) was immediately applied to Liquid composition 1 to print a solid image.

Examples 2 to 22 and Comparative Examples 1 to 4

The same procedures as in Example 1 were conducted in each of Examples 2 to 22 and Comparative Examples 1 to 5 except that the material, form, and diameter (when in a roller-like form) of the substrate of the contact member, and the type and thickness of the fluororesin fiber in Example 1 were changed as shown in Table 1 below.

As in Example 1, the tackiness of the solid-image region was measured in each of Examples 2 to 22 and Comparative Examples 1 to 5. The results are shown in Table 1.

For Examples 12 and 13 in which the substrates did not have a roller-like form, the printing device including the contact member 1 was not used for printing.

In Table 1 below, "-" in the "Resin fiber layer" columns for Comparative Examples 2 and 3 means that no resin layer was formed, so that the substrate formed the uppermost surface of the contact member. In Table 1 below, "*l" in Comparative Example 5 represents a structure in which the surface of glass fiber was covered with hardened fluororesin.

The trade names and the manufacturing companies of the contact members and the fluororesin fibers shown in Table 1 are as follows:

TOYOFLON 2402 (fluororesin fiber, multifilament, manufactured by Toray Industries, Inc.);

TOYOFLON 1412 (fluororesin fiber, multifilament, manufactured by Toray Industries, Inc.);

Chuko Flow G-type fabric FGF-400-22 (manufactured by Chukoh Chemical Industries, Ltd.);

Aluminum flat plate (25 mm square, trade name: A5052P-K, manufactured by MISUMI Group Inc.);

Sintered-metal flat plate (25 mm sides, trade name: EB series, manufactured by SMC Corporation); and Sintered-metal roller (manufactured by Shinoda & Co. Ltd.)

Transfer Property 1

In each of Examples 1 to 22 and Comparative Examples 1 to 5, the transfer property of the liquid composition on the contact-target member onto the contact member was evaluated. Specifically, after the above-described procedures of "Contact between contact member and solid-image region of contact-target member", the resultant solid-image region was visually observed from a distance of 300 mm. In the solid-image region, an area of 25 mm square was randomly selected from the region having been in contact with the contact member, and the number of peeling-off points of the solid image within the area was counted. The transfer property was evaluated according to the following evaluation criteria. The results are shown in Table 1. The contact member was determined as practically usable when graded C or above.

Evaluation Criteria

A: 2 or less peeling-off points

B: 3 to 5 peeling-off points

C: 6 to 10 peeling-off points

D: 11 or more peeling-off points

Transfer Property 2

In each of Examples 1 to 11 and 14 to 22 and Comparative Examples 1 to 5, the transfer property of the liquid composition on the contact-target member onto the contact member was evaluated. Specifically, after the above-described procedures of "Printing with printing device including contact member", the resultant solid-image region was visually observed from a distance of 300 mm. In the solid-image region, an area of 25 mm square was randomly selected from the region having been in contact with the contact member, and the number of peeling-off points of the solid image within the area was counted. The transfer property was evaluated according to the following evaluation criteria. The results are shown in Table 1. The contact member was determined as practically usable when graded C or above.

Evaluation Criteria

A: 2 or less peeling-off points

B: 3 to 5 peeling-off points

C: 6 to 10 peeling-off points

D: 11 or more peeling-off points

TABLE 1

| | Resin fiber layer | | | Substrate | | |
|---|---|---|---|---|---|---|
| | Trade name | Fiber structure | Thickness | Material | Form | Diameter |
| Example 1 | TOYOFLON BF800S | Mono filament | 800 m | Aluminum | Hollow roller | 75 mm |
| Example 2 | TOYOFLON BF800S | Mono filament | 800 m | Aluminum | Hollow roller | 75 mm |
| Example 3 | TOYOFLON BF800S | Mono filament | 800 m | Aluminum | Hollow roller | 75 mm |
| Example 4 | TOYOFLON BF800S | Mono filament | 800 m | Aluminum | Hollow roller | 75 mm |
| Example 5 | TOYOFLON BF800S | Mono filament | 580 m | Alii minimi | Hollow roller | 75 mm |
| Example 6 | TOYOFLON BF800S | Mono filament | 600 m | Aluminum | Hollow roller | 75 mm |
| Example 7 | TOYOFLON BF800S | Mono filament | 1000 m | Aluminum | Hollow roller | 75 mm |
| Example 8 | TOYOFLON BF800S | Mono filament | 1300 m | Aluminum | Hollow roller | 75 mm |
| Example 9 | TOYOFLON BF800S | Mono filament | 520 m | Aluminum | Hollow roller | 75 mm |
| Example 10 | TOYOFLON 2402 | Multi filament | 550 m | Aluminum | Hollow roller | 75 mm |
| Example 11 | TOYOFLON 1412 | Multi filament | 700 m | Aluminum | Hollow roller | 75 mm |
| Example 12 | TOYOFLON BF800S | Mono filament | 800 m | Aluminum | Flat plate | — |
| Example 13 | TOYOFLON BF800S | Mono filament | 800 m | Sintered metal | Flat plate | — |
| Example 14 | TOYOFLON BF800S | Mono filament | 800 m | Sintered metal | Hollow roller | — |
| Example 15 | TOYOFLON BF800S | Mono filament | 800 m | Aluminum | Hollow roller | — |
| Example 16 | TOYOFLON BF800S | Mono filament | 800 m | Aluminum | Hollow roller | — |
| Example 17 | TOYOFLON BF800S | Mono filament | 800 m | Aluminum | Hollow roller | — |

TABLE 1-continued

| | | | | | | |
|---|---|---|---|---|---|---|
| Example 18 | TOYOFLON BF800S | Mono filament | 800 m | Aluminum | Hollow roller | — |
| Example 19 | TOYOFLON BF800S | Mono filament | 800 m | Aluminum | Hollow roller | 50 mm |
| Example 20 | TOYOFLON BF800S | Mono filament | 800 m | Alumiuum | Hollow roller | 60 mm |
| Example 21 | TOYOFLON BF800S | Mono filament | 800 m | Aluminum | Hollow roller | 90 mm |
| Example 22 | TOYOFLON BF800S | Mono filament | 800 m | Aluminum | Hollow roller | 100 mm |
| Comparative Example 1 | TOYOFLON BF800S | Mono filament | 250 m | Aluminum | Hollow roller | — |
| Comparative Example 2 | — | — | — | Aluminum | Hollow roller | — |
| Comparative Example 3 | — | — | — | Aluminum | Hollow roller | 75 mm |
| Comparative Example 4 | TOYOFLON BF800S | Mono filament | 450 m | Aluminum | Hollow roller | 75 mm |
| Comparative Example 5 | Clinko Flow G-type fabric FGF-400-22 | *1 | 540 m | Aluminum | Hollow roller | 75 mm |

| | Winding ratio | Drying time | Tackiness | Transfer property 1 | Transfer property 2 |
|---|---|---|---|---|---|
| Example 1 | 50% | 2 seconds | 70 nN | B | B |
| Example 2 | 50% | 3 seconds | 80 nN | A | A |
| Example 3 | 50% | 4 seconds | 110 nN | A | A |
| Example 4 | 50% | 5 seconds | 120 nN | B | B |
| Example 5 | 50% | 3 seconds | 80 nN | B | B |
| Example 6 | 50% | 5 seconds | 80 nN | A | A |
| Example 7 | 50% | 3 seconds | 80 nN | A | A |
| Example 8 | 50% | 3 seconds | 80 nN | C | C |
| Example 9 | 50% | 3 seconds | 80 nN | C | C |
| Example 10 | 50% | 3 seconds | 80 nN | C | C |
| Example 11 | 50% | 3 seconds | 80 nN | C | C |
| Example 12 | — | 3 seconds | 80 nN | A | — |
| Example 13 | — | 3 seconds | 80 nN | B | — |
| Example 14 | 50% | 3 seconds | 80 nN | B | B |
| Example 15 | 25% | 3 seconds | 80 nN | B | B |
| Example 16 | 90% | 3 seconds | 80 nN | B | B |
| Example 17 | 40% | 3 seconds | 80 nN | A | A |
| Example 18 | 80% | 3 seconds | 80 nN | A | A |
| Example 19 | 50% | 3 seconds | 80 nN | B | B |
| Example 20 | 50% | 3 seconds | 80 nN | A | A |
| Example 21 | 50% | 3 seconds | 80 nN | A | A |
| Example 22 | 50% | 3 seconds | 80 nN | B | B |
| Comparative Example 1 | 50% | 3 seconds | 80 nN | D | D |
| Comparative Example 2 | 50% | 3 seconds | 80 nN | D | D |
| Comparative Example 3 | 50% | 3 seconds | 80 nN | D | D |
| Comparative Example 4 | 50% | 3 seconds | 80 nN | D | D |
| Comparative Example 5 | 50% | 3 seconds | 80 nN | D | D |

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

This patent application is based on and claims priority pursuant to 35 U.S.C. § 119(a) to Japanese Patent Application No. 2018-51310, filed on Mar. 19, 2018, in the Japan Patent Office, the entire disclosure of which is hereby incorporated by reference herein.

REFERENCE SIGNS LIST

1 Contact-target-member-feeding device
2 Liquid composition applying device
3 Liquid composition heating device
4 Contact member
5 Contact-member-heating device
6 Contact-target-member-collecting device
7 Contact-target member
8 Conveying path
9*a*, 9*b* Ends (of portion of contact-target member) where contact-target member is separated from contact member
100 Printing device

The invention claimed is:

1. A contact member comprising:

a surface comprising a fluororesin fiber layer comprising a fluororesin fiber, wherein the surface contacts a contact-target member having an area to which a liquid composition is applied and the fluororesin fiber layer has a thickness of 500 μm or more.

2. The contact member according to claim 1, wherein the fluororesin fiber comprises a monofilament.

3. The contact member according to claim 1, wherein the fluororesin fiber layer has a thickness of from 600 to 1000 μm.

4. The contact member according to claim 1, further comprising a porous substrate on which the fluororesin fiber layer is disposed.

5. The contact member according to claim 1, further comprising a porous substrate on which the fluororesin fiber layer is disposed, wherein the porous substrate has a roller-like form having a diameter of from 50 to 100 mm.

6. The contact member according to claim 1, further comprising an aluminum substrate on which the fluororesin fiber layer is disposed.

7. A printing device comprising:

a contact member configured to be brought into contact with a liquid composition applied area of a contact-target member, the contact member comprising a surface comprising a fluororesin fiber layer comprising a fluororesin fiber, wherein the fluororesin fiber layer has a thickness of 500 μm or more.

8. The printing device according to claim 7, wherein the fluororesin fiber comprises a monofilament.

9. The printing device according to claim 7, wherein the fluororesin fiber layer has a thickness of from 600 to 1000 μm.

10. The printing device according to claim 7, further comprising a porous substrate on which the fluororesin fiber layer is disposed.

11. The printing device according to claim 7, further comprising an aluminum substrate on which the fluororesin fiber layer is disposed.

12. The printing device according to claim 7, further comprising a porous substrate on which the fluororesin fiber layer is disposed, wherein the substrate has a roller-like form having a diameter of from 50 to 100 mm.

13. The printing device according to claim 7, wherein the contact member comprises a roller, wherein the contact-target member winds around the roller to cause the roller to be in contact with the liquid composition applied area, and wherein a winding-around ratio of the contact-target member to the roller is 10 percent or more.

14. The printing device according to claim 7, wherein the liquid composition applied area has a tackiness of from 80 to 110 nN.

15. The printing device according to claim 7, further comprising a liquid composition applying device configured to apply the liquid composition to the contact-target member.

16. The printing device according to claim 7, wherein the liquid composition comprises a coloring material, water, an organic solvent, and wax.

17. The printing device according to claim 7, further comprising a contact member heating device configured to heat the contact member.

18. The printing device according to claim 7, further comprising a liquid composition heating device configured to heat the liquid composition which has been applied to the contact-target member.

19. The printing device according to claim 18, wherein the contact member is disposed downstream of the liquid composition heating device in a conveyance direction of the contact-target member.

20. A printing method, comprising:

applying a liquid composition to a contact-target member; and causing a contact member to contact a surface of the contact-target member, wherein the surface comprises a fluororesin fiber layer comprising a fluororesin fiber, and wherein the fluororesin fiber layer has a thickness of 500 μm or more.

* * * * *